United States Patent [19]

Crowe

[11] 4,196,952

[45] Apr. 8, 1980

[54] CABINET CORNER CAP ASSEMBLY

[75] Inventor: William P. Crowe, Louisville, Ky.

[73] Assignee: General Electric Company, Louisville, Ky.

[21] Appl. No.: 947,928

[22] Filed: Oct. 2, 1978

[51] Int. Cl.[2] ..... F16B 12/00; B65D 7/00

[52] U.S. Cl. ..... 312/236; 24/263 R; 220/434; 312/140

[58] Field of Search ..... 312/236, 204, 140, 257 R, 312/257 SK, 257 SM; 220/73, 80, 432, 433, 434; 248/345.1; 24/263 R

[56] References Cited

U.S. PATENT DOCUMENTS

| | | | |
|---|---|---|---|
| 2,367,886 | 1/1945 | Nauert | 220/434 |
| 2,942,924 | 6/1960 | Stangert | 312/140 |

*Primary Examiner*—Alexander Grosz
*Attorney, Agent, or Firm*—Frederick P. Weidner; Radford M. Reams

[57] ABSTRACT

A cabinet corner cap assembly for insertion into a space at the junction of two panels of a cabinet. The corner cap assembly includes a corner cap that has a top and two downwardly projecting breakable studs inserted through the cabinet space. A foam seal element through which the studs pass is also provided. There is a clip having two openings to receive therethrough the corner cap studs with the clip openings being dimensioned to frictionally grip the studs. The clip is retained in a housing which housing abuts the junction of the cabinet panels and also has a projection with two openings to also receive therethrough the corner cap studs. A corner bracket shaped correspondingly to the cabinet panels and secured thereto has a tang spaced from the junction of the cabinet panels and positioned such that the clip housing projection abuts the top of the tang. The tang has an opening in alignment with one of the corner cap studs and that opening is dimensioned to allow free passage of the stud therethrough in the event of breakage of the stud. The other stud, upon breakage, passes through the space between the tang and the junction of the cabinet panels.

8 Claims, 3 Drawing Figures

CABINET CORNER CAP ASSEMBLY

BACKGROUND OF THE INVENTION

In the construction of a cabinet, such as a household refrigerator cabinet, it is often desirable to provide a corner cap to cover the open miter at the corners of the outer case such as a prepainted foamed insulation refrigerator outer case. In such cases, it is also desirable to provide a seal at the corners to prevent the leakage of insulating foam through the open miter during the foam-in process. It is further desirable that the corner cap be as thin as possible to present minimum interference with the gasket sealing effectiveness such as in the case of a refrigerator where the gasket around the door insulates the interior of the refrigerator from the ambient atmosphere. In addition, the corner cap must be firmly retained so that removal is not possible without breaking the cap and, accordingly, the cap should be easily replaceable in the event it breaks during manufacture or during field service of the refrigerator. The corner cap and its assembly process must be able to tolerate case or cabinet dimensional variation as occurs in manufacture of the cabinet. In the case of prepainted outer cabinet, the cap should also allow paint touch up of bare edges that often occur in the cabinet area beneath the cap.

By my invention, there is provided a corner cap assembly for a cabinet such as a household refrigerator cabinet that accomplishes all of the above mentioned desirable attributes.

SUMMARY OF THE INVENTION

There is provided a corner cap assembly for insertion into a space at the junction of two panels of a cabinet. There is included a corner cap having a top and two downwardly projecting breakable studs, which studs are inserted through the cabinet space. There is a foam seal element through which the studs pass and a clip having two openings to receive therethrough the corner cap studs with the clip openings dimensioned to frictionally grip and hold the studs. The clip is retained in a housing, which housing abuts the junction of the panels and has a projection and also two openings to receive therethrough the corner cap studs. There is a corner bracket shaped to correspond to the cabinet panels and is secured to the cabinet panels. The corner bracket has a tang spaced from the junction of the cabinet panels and positioned such that the clip housing projection abuts the top of the tang. The tang has an opening in alignment with one of the corner cap studs and that opening is dimensioned to allow free passage of the stud therethrough in the event of breakage of the stud while the other stud upon breakage passes through the space between the tang and the junction of the cabinet panels. By this assembly, the replacement of the corner cap may be easily accomplished by breaking the studs and allowing them to fall through the respective openings of the corner cap assembly and the top of the corner cap may be removed and a new corner cap with studs may be reinserted into the assembly. In addition, by this assembly, foam-in insulation reactant materials during manufacture of the refrigerator are prevented from leaking out the space at the junction of the two cabinet panels.

DESCRIPTION OF THE PREFERRED EMBODIMENT

Figure 1:
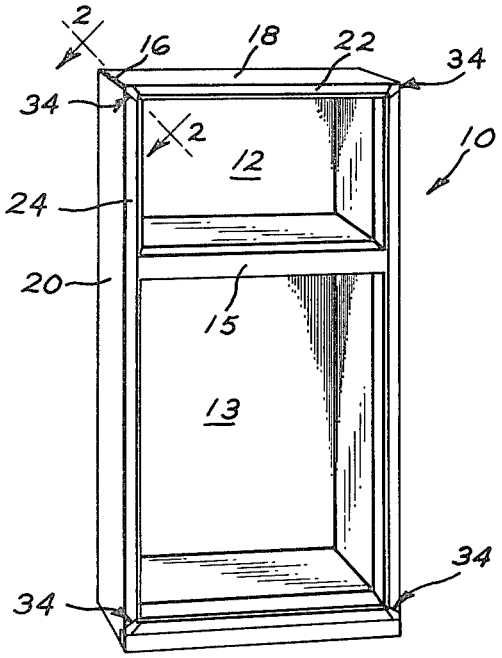
FIG. 1 is a perspective view of a top mount refrigerator cabinet showing both the fresh food compartment below and the freezer compartment above and including the corner cap assembly of the present invention.

Referring to FIG. 1, a refrigerator outer case or cabinet 10 such as a top mount household refrigerator, for example, has a freezing compartment 12, and a fresh food compartment 13 separated by a partition 15. The freezer compartment and the fresh food compartment would have a door or doors (not shown) for closing the respective compartments when the refrigerator is completely assembled. The cabinet 10 is constructed from sheet metal and in many cases from a single sheet of metal with the corners, such as corner 16, being bent to form a radius or curved section such as between top panel 18 and side panel 20 which are disposed at right angles to each other. To provide a surface or face at the front of the refrigerator cabinet 10, the panels of the cabinet have depending flanges such as flanges 22 and 24 for panels 18 and 20 respectively and these flanges provide surfaces against which the freezer and fresh food compartment door gasket (not shown) may be urged for thermal sealing of those compartments. The flanges 22 and 24 may have down-turned extensions 26 to accommodate other structures and add rigidity to the cabinet 10. While the invention will be described in connection with only one corner 16, it will be understood that the corner cap assembly may be used on the other corners of the cabinet 10.

Figure 3:
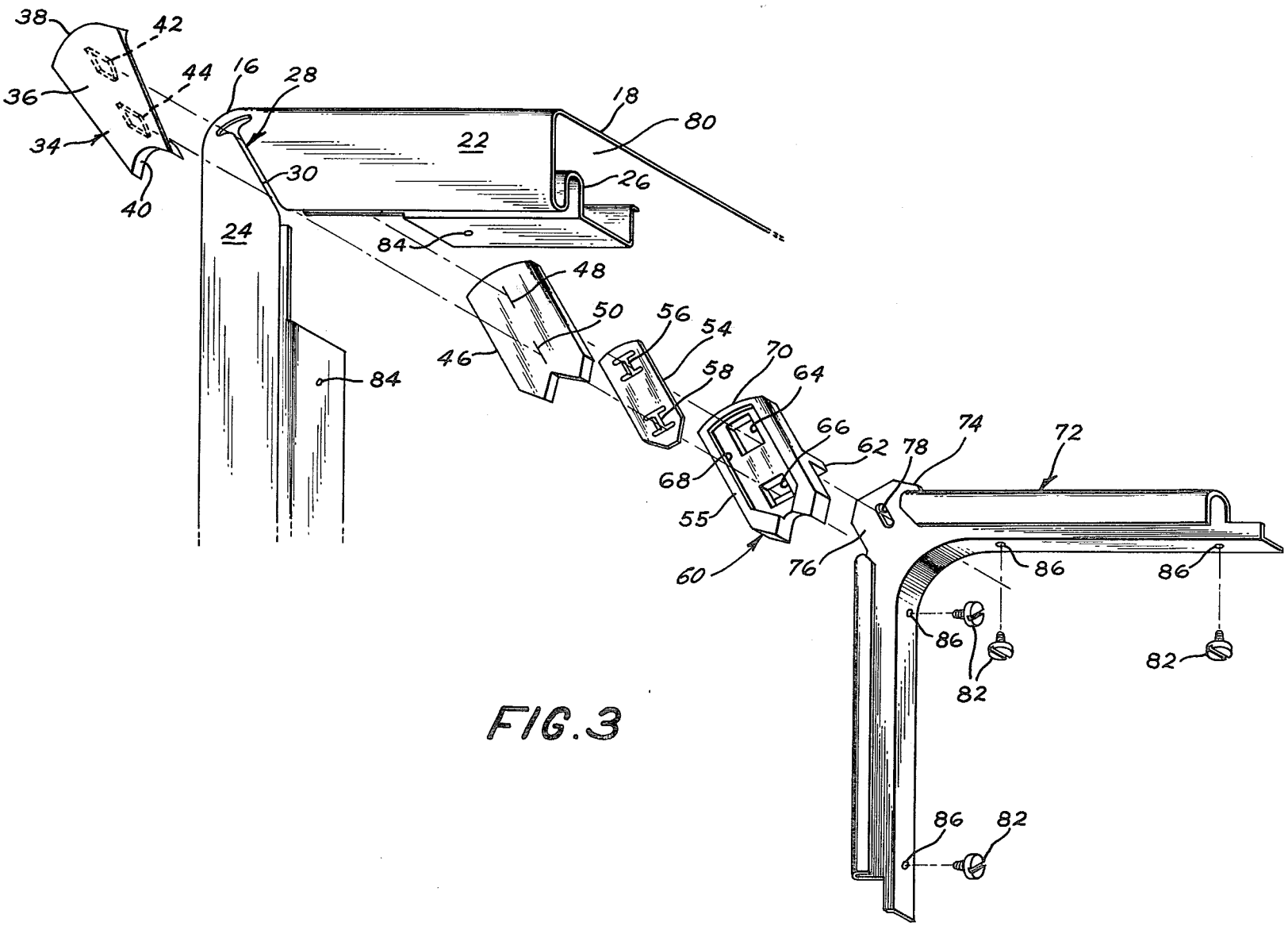
FIG. 3 is an exploded perspective view of the corner cap assembly of the present invention.

As best seen in FIG. 3, to accomplish bending of the panels 18 and 20 and their respective flanges 22 and 24 during the forming of the cabinet 10, there must necessarily be a miter joint 28 to allow the panels and flanges to be formed at right angles to each other without interference of the overlapping material. The miter joint includes a slit 30 from the end of the flange away from the panels 18 and 20 back to the curved corner 16 where there is additional relief so that the metal will not wrinkle during the forming operation. It is this slit 30 that needs to be covered by a corner cap 34.

Figure 2:
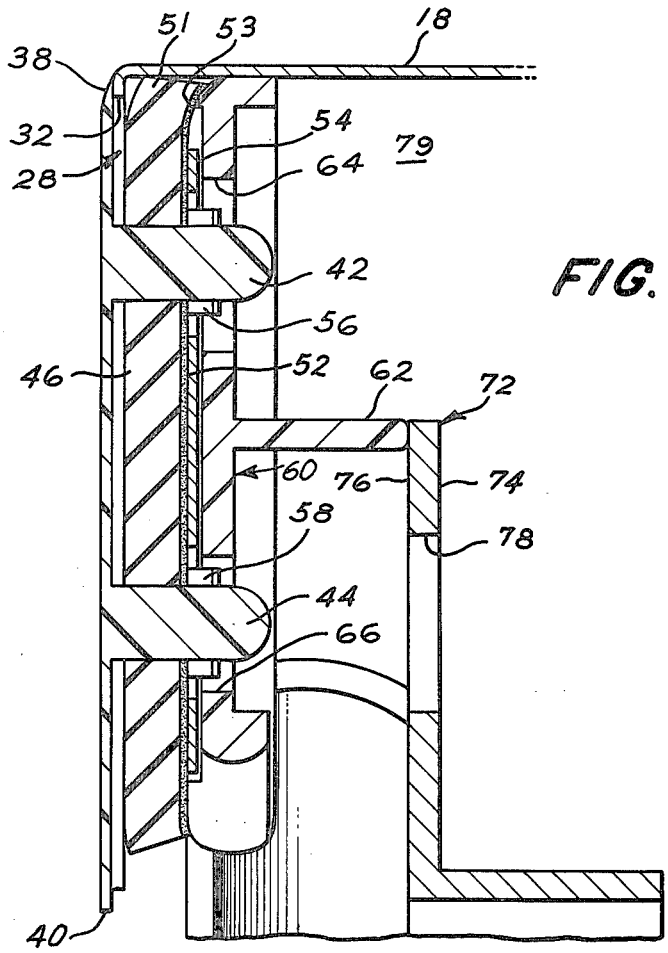
FIG. 2 is a cross sectional view taken along lines 2—2 of FIG. 1 and rotated to show the corner cap assembly of the present invention.

With reference particularly to FIGS. 2 and 3, the details of a corner cap assembly of the present invention will now be discussed. The corner cap 34 is preferably made from plastic and includes a top 36 which has one end 38 curved to correspond to the curve of the corner 16 between the panels 18 and 20. The opposite end 40 of the corner cap 34 may also be curved to provide a smooth transition and neat appearance between the flange 22 and flange 24. The corner cap 34 may be tapered to again give a pleasant appearance and accommodate the shape and configuration of the miter joint between the two panels 18 and 20. The top 36 of the corner cap 34 is as thin as possible so that it will not interfere with the gasket sealing qualities when in the final construction of the refrigerator the door gasket will seal against the flanges around the fresh food and freezer compartments. The corner cap 34 has two spaced breakable studs 42 and 44 projecting downwardly from the top 36. The corner cap 32 is placed over the miter joint 28 with the studs 42 and 44 passing through the slit 30 between the flanges 22 and 24. Inside the cabinet 10 and underlying the flanges 22 and 24 are the following components of the corner cap assembly.

There is a foam seal element 46 that has slits 48 and 50 for receiving therethrough the studs 42 and 44 respectively of the corner cap 34. The underside 52 of the foam seal element 46 may be provided with a suitable adhesive 53, the purpose of which will be explained later. One end 51 of the foam seal element 46 is curved to correspond to the curve of the corner 16 between cabinet panels 18 and 20 and is urged thereagainst to provide an abutting arrangement.

Underlying the foam seal element 46 is a clip 54 that has two openings 56 and 58 to receive therethrough the corner cap studs 42 and 44 respectively. The clip openings 56 and 58 are dimensioned to frictionally grip the studs 42 and 44. Preferably, the clip 54 is made from spring steel to enhance the gripping qualities of the clip relative to the studs 42 and 44. The clip 54 is retained in a housing 60, which housing has a downwardly directed projection 62 and also two openings 64 and 66 for receiving therethrough the studs 42 and 44 respectively of the corner cap 34. The top of the clip housing 60 has a recessed area 68 for receiving therein the clip 54. The recessed area 68 is dimensioned to be larger than the clip 54 so that the clip is retained therein in a sloppy fit. The sloppy fit is so that manufacturing tolerance differences may be accommodated during assembly of the corner cap assembly. One end 70 of the clip housing 60 is curved to correspond to the curve of the corner 16 between cabinet panels 18 and 20 and the one end 70 abuts the corner 16.

As mentioned above, the foam seal element 46 on its underside 52 has a suitable adhesive so that when the clip 54 is received in the recess 68 of the clip housing 60, it is retained therein by the adhesive of the foam seal element 46 adhering to both the clip 54 and the outer periphery 55 of the clip housing that surrounds the recessed area 68. It should be noted that the foam seal element 46 is larger in dimension than the clip 54 to accomplish this purpose.

The final component of the corner cap assembly is a corner bracket 72 which is generally shaped as a right angle to correspond to the right angle shape of joined cabinet panels 18 and 20 and the corner bracket is secured to these panels. Corner bracket 72 has a tang 74 which is spaced from the junction or corner 16 of the cabinet panels 18 and 20 and is positioned such that the clip housing projection 62 abuts the top surface 76 of the tang 74 as best shown in FIG. 2. The tang 74 has an opening 78 which is in alignment with corner cap stud 44 and is dimensioned to allow free passage of that stud therethrough in the event of breakage of the stud. In the case of stud 42, upon its breakage that stud may pass through the space between the tang 74 and the junction of cabinet panels 18 and 20 generally shown at 79.

The corner bracket 72 may be formed in various shapes to accommodate the desired cabinet configuration and, in this case, each of the right angle legs of the bracket is shaped to correspond to the down-turned extension 26 of the flanges 22 and 24 and are received in the space 80 between the down-turned extension 26 and the panels 18 and 20. The corner bracket 72 is secured by any suitable means such as by fasteners 82 through holes 84 in the down-turned extension 26 and holes 86 in the respective legs of the bracket 72.

With the above-described corner cap assembly, it will be noted that in the event the corner cap 34 needs to be replaced, either during manufacture or field service, the studs 42 and 44 are broken as by applying force on the top 36 at a right angle to the studs 42 and 44, thus allowing the top 36 to be removed and then the studs are forced through the foam seal element 46, the openings 56 and 58 in the clip 54 and the openings 64 and 66 in the clip housing 60 and fall into the interior of the cabinet 10 through tang opening 78 and space 79. A new corner cap 34 is then merely again positioned so that the studs 42 and 44 pass through the slit 30 of the miter joint 28 and the corner cap 34 is retained in its position by the frictional engagement of the studs in the openings 56 and 58 of the clip 54.

With the above-described corner cap assembly, it will also be noted that the foam seal element 46 overlies the openings 56 and 58 in clip 54 and openings 64 and 66 of the clip housing 60. The one end 51 of the foam seal element 46 abuts the curved corner 16 and panels 18 and 20. In this manner, foam-in insulation reactant materials during manufacture of the refrigerator are prevented from reaching the slit 30 of the miter joint 28. The foam insulation is, therefore, retained within the cabinet walls where it is needed and cannot leak through the slit 30.

The foregoing is a description of the preferred embodiment of the invention and it should be understood that variations may be made thereto without departing from the true spirit of the invention as defined in the appended claims.

What is claimed is:

1. A corner cap assembly for insertion into a space at the junction of two panels of a cabinet comprising:
   (a) a corner cap having a top and two downwardly projecting breakable studs inserted through the cabinet space,
   (b) a foam seal element through which the studs pass,
   (c) a clip having two openings to receive therethrough the corner cap studs, said clip openings dimensioned to frictionally grip the studs,
   (d) a clip housing for retaining the clip, said housing abutting the junction of the cabinet panels and having a projection and two openings to receive therethrough the corner cap studs,
   (e) a corner bracket shaped correspondingly to the cabinet panels and secured thereto and having a tang spaced from the junction of the cabinet panels and positioned such that the clip housing projection abuts the top of the tang, said tang having an opening in alignment with one of the corner cap studs and dimensioned to allow free passage of the stud therethrough in the event of breakage of the stud and the other stud passing through the space between the tang and the junction of the cabinet panels in the event of breakage thereof.

2. The corner cap assembly of claim 1 wherein the clip housing has a recessed area to receive the clip.

3. The corner cap assembly of claim 2, wherein the recessed area is dimensioned to receive the clip in a sloppy fit.

4. The corner cap assembly of claim 1 wherein the foam seal element is a foam pad larger in dimension than the clip and has adhesive coating to adhere to the clip and clip housing to thus retain the clip in the clip housing.

5. The corner cap assembly of claim 1 wherein the junction of the two panels of the cabinet is curved and the top of the corner cap has one end correspondingly curved to the curve of the junction of the cabinet panels.

6. The corner cap assembly of claim 1 wherein the two panels of the cabinet are curved at their junction and the clip housing has one end curved and abuts the curved junction of the cabinet panels.

7. The corner cap assembly of claim 1 wherein the corner cap is molded from breakable plastic material.

8. The corner cap assembly of claim 1 wherein the clip is made of spring steel.

* * * * *